US006857347B1

(12) United States Patent
Benedict et al.

(10) Patent No.: US 6,857,347 B1
(45) Date of Patent: Feb. 22, 2005

(54) SAFETY GUARD FOR BAND SAWS

(75) Inventors: Charles E. Benedict, 3207 Remington Run, Tallahassee, FL (US) 32312; Stephen R. Corbett, Tallahassee, FL (US); Christian Tallahassee Yates, Tallahassee, FL (US); Farhad Booeshaghi, Tallahassee, FL (US)

(73) Assignee: Charles E. Benedict, Tallahassee, FL (US)

( * ) Notice: Subject to any disclaimer, the term of this patent is extended or adjusted under 35 U.S.C. 154(b) by 20 days.

(21) Appl. No.: 10/389,809

(22) Filed: Mar. 18, 2003

(51) Int. Cl.[7] ..... B26D 7/22; B26D 1/54

(52) U.S. Cl. ..... 83/546; 83/820; 83/860; 83/DIG. 1

(58) Field of Search ..... 83/788, 357, 357.1, 83/DIG. 1, 820, 478, 544, 546, 860

(56) References Cited

U.S. PATENT DOCUMENTS

| | | | | | |
|---|---|---|---|---|---|
| 1,054,288 | A | | 2/1913 | Fleming | |
| 1,186,600 | A | | 6/1916 | Neill | |
| 1,258,695 | A | | 3/1918 | Miller et al. | |
| 1,264,332 | A | | 4/1918 | Przepiorka | |
| 1,270,285 | A | | 6/1918 | Good | |
| 1,369,824 | A | | 3/1921 | McDonnell | |
| 1,384,742 | A | * | 7/1921 | Clark | 83/167 |
| 1,749,063 | A | | 3/1930 | Brown | |
| 2,371,731 | A | * | 3/1945 | Boice et al. | 83/814 |
| 2,538,456 | A | * | 1/1951 | Howe, Jr. | 83/814 |
| 2,764,189 | A | * | 9/1956 | Haydon | 83/102.1 |
| 2,827,085 | A | | 3/1958 | Ocenasek | |
| 3,104,688 | A | | 9/1963 | Bretthauer | |
| 3,848,502 | A | | 11/1974 | O'Neill | |
| 3,888,148 | A | | 6/1975 | Weissman | |
| 3,939,749 | A | | 2/1976 | Müller | |
| 3,974,724 | A | | 8/1976 | Shadle | |
| 4,625,604 | A | * | 12/1986 | Handler et al. | 83/102.1 |
| 5,782,001 | A | * | 7/1998 | Gray | 30/391 |
| 6,595,097 | B2 | * | 7/2003 | Lee | 83/814 |
| 6,679,148 | B2 | * | 1/2004 | Chiang | 83/788 |

* cited by examiner

*Primary Examiner*—Boyer D. Ashley
(74) *Attorney, Agent, or Firm*—Dowell & Dowell, P.C.

(57) ABSTRACT

The safety device for a band saw which includes a vertically displaceable guard which is slidably mounted to a housing of the saw and having a lower end adjacent the table of saw and wherein a pivotable shield is carried by the lower end of the guard. A locking mechanism normally secures the guard in a lowered covering relationship to a band saw blade and must be manually released to permit raising of the guard to allow a workpiece to be moved beneath the shield to be cut by the band saw blade.

19 Claims, 5 Drawing Sheets

21
11
34
13
40
14
43
41
42
31
30
20
10
20
58
50
16
24
27
28
22
23

SAFETY GUARD FOR BAND SAWS

BACKGROUND OF THE INVENTION

Field of the Invention

This invention is generally directed to safety guards or shields used with power cutting tools and, more particularly, to a guard for covering an exposed portion of a band saw blade which normally extends between a housing of the band saw and a work table through which the band saw blade passes and which table is in spaced relationship below to the housing. The guard is specifically designed to be retained in a covering relationship with respect to the normally exposed portion of the band saw blade unless manually released and thereafter, once a workpiece is cut, the guard automatically locks in a lowered covering relationship with respect to the saw blade to thereby prevent accidental contact with the saw blade by an operator.

The guard also supports a shield which extends radially outwardly from a lower portion thereof through which the band saw blade passes. The shield prevents accidental contact with the blade when the guard is raised to permit a workpiece to be cut by the saw blade.

BACKGROUND OF THE INVENTION

Conventional powered band saws include a continuous saw blade which extends between two spaced drive wheels or sprockets which are vertically spaced both above and below a cutting table. The band saw blade passes through a slot in the cutting table and is normally driven by a motor which may be mounted to a frame below the cutting table or within a housing positioned above the cutting table. During normal use when the motor is activated to drive the band saw blade, a workpiece is moved into relationship with a cutting edge of the band saw to thereby effect necessary cuts in the workpiece.

Unfortunately, conventional band saws have a significant portion of the saw blade exposed between the housing and the band saw table in order to provide space to maneuver a workpiece relative to the blade when the workpiece is supported on a support surface of the table. Because of this exposed length of cutting blade, numerous accidents have occurred by workers or operators accidently contacting the blade.

To improve the safe operating characteristics of conventional band saws, there have been a number of innovations developed to protect workers from accidental contact with the normally exposed portion of the saw blade. However, conventional band saw blade guards do not provide adequate protection to prevent accidental contact with the saw blade under many circumstances. Often, conventional guards can be inadvertently moved from a covering relationship with respect to the saw blade thereby creating a possibly hazardous condition wherein an operator can accidently make contact with the unprotected blade. In other types of conventional guards, the guards, when released from a safety position, are retained in a non-covering position until action is taken to manually move the guards to a covering position. The reliance on manual return of a guard to a safety position creates a further potentially hazardous condition.

In addition to the foregoing, many guards which have been designed for use with band saws only provide a structure which shields a portion of the length of the band saw blade and do not provide any safety structure for preventing accidental contact of a worker's hands with the saw blade when a workpiece is being maneuvered relative to the saw blade. That is, many guards, when moved to permit access to the band saw blade for cutting of a workpiece, allow a worker's hand to be moved without obstruction at substantially any point relative to the cutting edge of the band saw blade and, there is no shield or barrier to prevent accidental contact by the operator with the exposed portion of the blade while maneuvering a workpiece.

In view of the foregoing, there remains a need, not only to provide a band saw guard which is more reliable and failsafe and which will function to prevent accidental contact with the band saw blade whenever the band saw is operating and a workpiece is not positioned relative to the blade for cutting, but also to provide for a shield to prevent accidental engagement with the saw blade when the blade is being used to cut a workpiece.

SUMMARY OF THE INVENTION

The present invention is directed to a safety device for use with band saws which include generally continuous band saw blades and which conventionally have one run or section of the blade in extending an exposed manner from a housing which is spaced vertically above a work support table. The safety device includes a guard member which is slidably mounted to the housing of the band saw so that a lower end of the guard is movable from the first position spaced closely adjacent to the table to a released position wherein the guard may be vertically adjustable upwardly depending upon the size of the workpiece which is to pass beneath the guard along the supporting surface of the table.

A locking mechanism is provided for normally securing the guard in the first position to thereby prevent accidental displacement of the guard. The locking mechanism is designed to be manually released to permit movement from the first position, such that a workpiece may pass beneath the guard when the saw is in use.

In a preferred embodiment, the lock mechanism is mounted to the guard so as to be movable therewith. Further, the lock may include a gravity actuated locking member which includes a pivotable latch carried by a bracket mounted to the guard. The latch is movable with respect to an opening in a portion of the saw housing in such a manner that the catch is engageable with the saw housing through the opening when the guard is in its lower or first position. In order to ensure that the locking mechanism automatically engages when the guard is in its lower or first position, in one embodiment, an elongated handle is provided which is integrally formed with the catch and which extends outwardly from the mounting bracket in such a manner as to provide a weight which normally pivots the catch to its locked engagement within the opening in the saw housing.

To release the locking mechanism of the preferred embodiment of the invention, the handle associated with the locking mechanism is raised to pivot the catch from the engaged position with the saw housing. Thereafter, the guard may be moved vertically relative to the cutting surface defined by the table of the saw. However, whenever a workpiece has passed beneath the guard, the guard automatically falls by gravity to its lower position and the weight of the handle automatically pivots the catch of the locking mechanism into engagement with the housing of the saw to thereby prevent accidental movement of the guard from its safe lower or first position.

The safety device of the present invention also includes a shield which is designed to be pivotally mounted to the lower end of the guard. The shield includes an outer periphery which extends generally transversely with respect to the lower end of the guard so as to generally surround the saw blade when the guard and shield are positioned relative thereto. The shield is designed to provide a barrier which extends radially outwardly in surrounding relationship with respect to the cutting blade of the saw whenever the band saw is in use to thereby prevent accidental contact with an exposed portion of the cutting blade as a worker manipulates a workpiece relative thereto.

In preferred embodiments, the shield has an outer peripheral edge which is beveled upwardly so as to facilitate the movement of a workpiece between the shield and the support surface of the table such that the movement of a workpiece beneath the shield automatically elevates the guard to the proper height to permit passage of the workpiece once the locking mechanism has been manually released.

In the preferred embodiment of the invention, the guard member is elongated and generally L-shaped in cross sectional configuration having a first flange or panel which extends along a side of the saw housing and which completely covers the forward cutting edge of the normally exposed portion of the band saw blade between the housing and the table. The guard further includes a second flange or panel which extends forwardly of the housing oriented toward the forward portion of the saw table. A substantially continuous slot is provided in the forward panel of the guard to permit generally continuous movement of the guard from its first lower position to any raised position necessary to permit passage of a workpiece between the work surface of the support table and the housing of the band saw.

It is the primary object of the present invention to provide a safety device for use with band saws which includes not only a guard which is normally locked in a completely covering position with respect to a normally exposed portion of the band saw blade which extends between a housing and a work support surface of a table of the saw, but which also includes a shield which extends radially outwardly relative to the band saw blade and which is designed to be supported on an upper surface of a workpiece being cut so as to prevent accidental contact with the band saw blade when a workpiece is being maneuvered relative to the blade.

It is a further object of the present invention to provide a safety device for a band saw wherein the safety device includes a locking mechanism which automatically locks the guard in a covering relationship with respect to a normally exposed portion of the band saw blade whenever a workpiece is not being cut by the band saw blade.

It is another object of the present invention to prevent accidental injury to workers or operators using band saws by providing a failsafe device which ensures that a normally exposed portion of a band saw blade is covered whenever a workpiece is not being worked on and which also prevents a worker's hands from engaging the band saw blade when manipulating a workpiece relative to the band saw blade.

It is also an object of the present invention to provide a safety device for band saws which may be retrofitted to conventional band saws in an inexpensive manner such that conventional band saws may be made safer for operators.

BRIEF DESCRIPTION OF THE DRAWINGS

A better understanding of the invention will be had with reference to the accompanying drawings wherein.

DESCRIPTION OF THE PREFERRED EMBODIMENT

Figure 8:
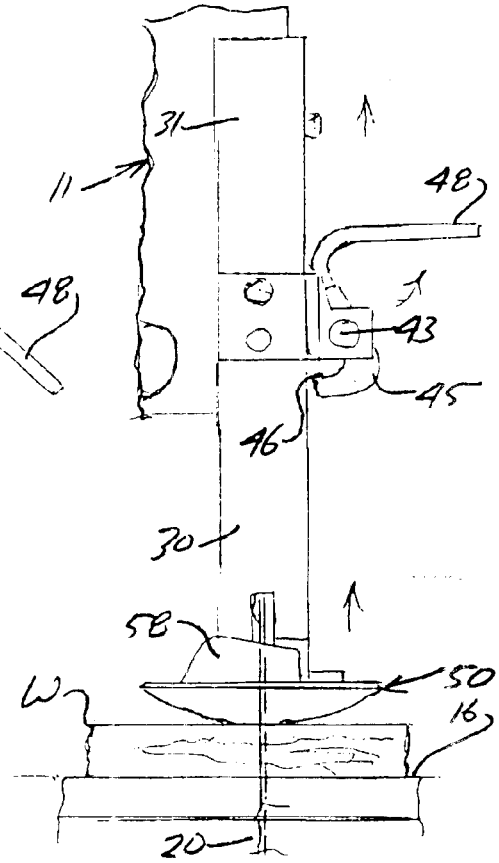
FIG. 8 is a view similar to FIG. 7 showing the safety device being elevated by passage of a workpiece after the locking mechanism has been released to permit such movement.

With continued reference to the drawing figures, the safety device 10 of the present invention is shown as being mounted to an upper housing 11 of a conventional powered band saw 12. The housing includes a door 13 which is pivotally mounted at 14 to a fixed housing cover 15. The housing 11 is vertically spaced relative to a table 16 having a workpiece support surface 17 along which workpieces "W" are guided relative to a continuous band saw blade 20, as is illustrated in FIG. 8.

Figure 3:
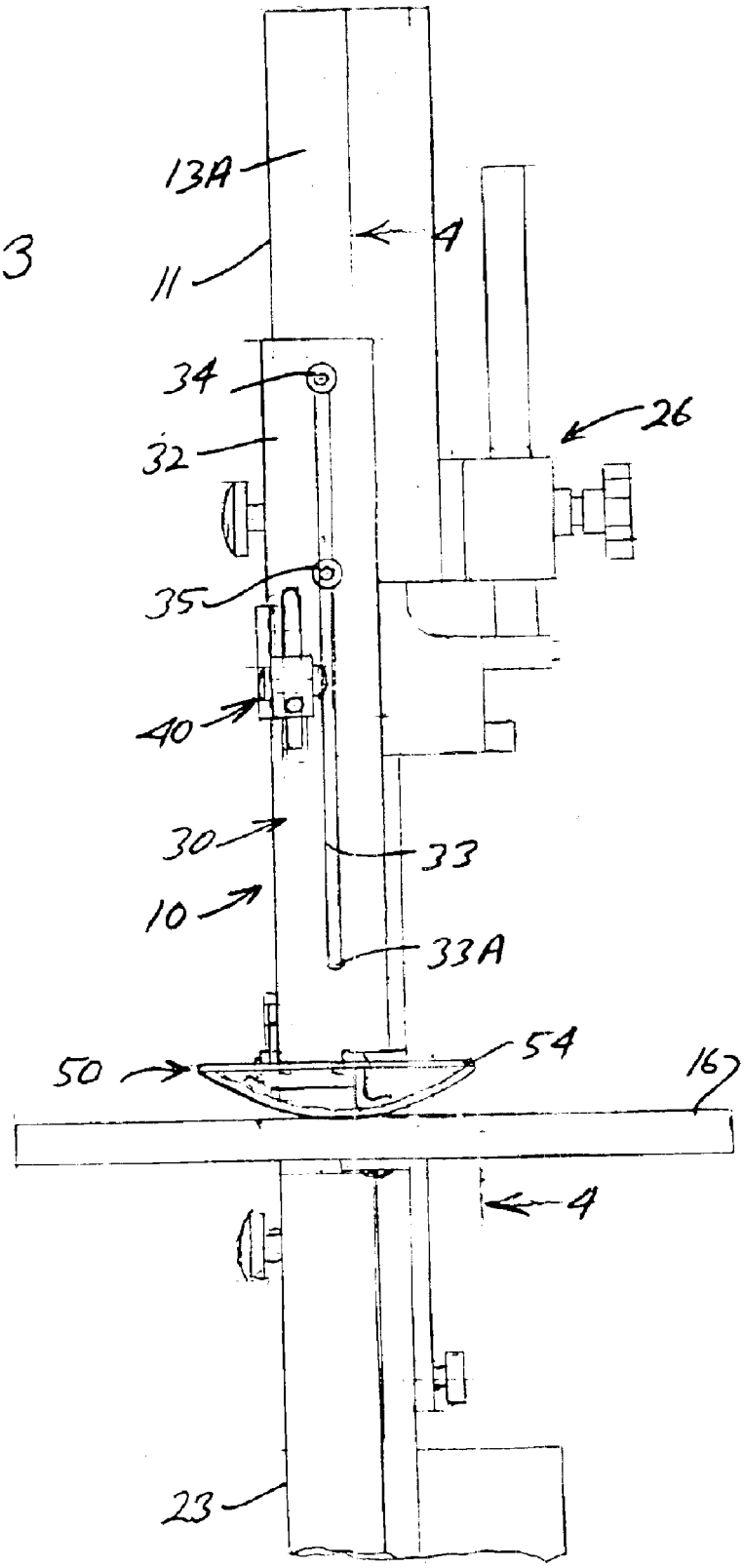
FIG. 3 is a partial front elevational view showing the safety device of the present invention as mounted on the band saw of FIG. 1.

The continuous band saw blade 20 is mounted about an upper guide wheel sprocket or roller 21 mounted within the housing 11 and a lower guide wheel, sprocket or roller 22 which is mounted within a lower housing 23 of the band saw. A motor, not shown, is mounted within the lower housing 23 so as to drive the wheel, sprocket or drive roller 22 to move the saw blade relative to the work support table 16. A rear run 20' of the saw blade extends within an enclosed support column 24 which supports the upper housing 11. Controls 25 are provided for engaging and disengaging the motor so as to cause motion of the saw blade 20. As shown in FIG. 3, an adjustment mechanism 26 is provided for raising and lowering the upper blade guide relative to the work support table 24 and the work support table 16.

The work support table 16 is pivotally mounted at 27 to the lower housing 23 and is supported by a guide arm 28 so that the table 16 can be pivoted to different angular positions depending upon the workpiece to be cut. With the band saw depicted in the drawing figures, a workpiece "W" is generally moved in the direction of arrow 29 in FIG. 1 relative to the forward cutting edge of the band saw blade 20 which edge is oriented to the left side in FIG. 1.

As with most conventional band saws, the continuous cutting blade 20 is safely enclosed within the upper and lower housings and the rear support column of the table saw leaving only a segment of the blade intermediate the housing 11 and the table 16 normally exposed for cutting. It is this exposed segment or run of the cutting blade which presents a very hazardous problem which has resulted in numerous operator injuries caused by accidental contact with the moving saw blade when the motor the band saw is engaged.

In order to overcome the problems with conventional band saws, the safety device 10 of the present invention includes and elongated guard member 30 which, in the embodiment shown in the drawing figures, includes a generally continuous side flange or wall 31 and a front wall or flange 32 having an elongated slot 33 formed therein. In this respect, a cross section of the guard member is generally L-shaped in configuration.

Figure 1:
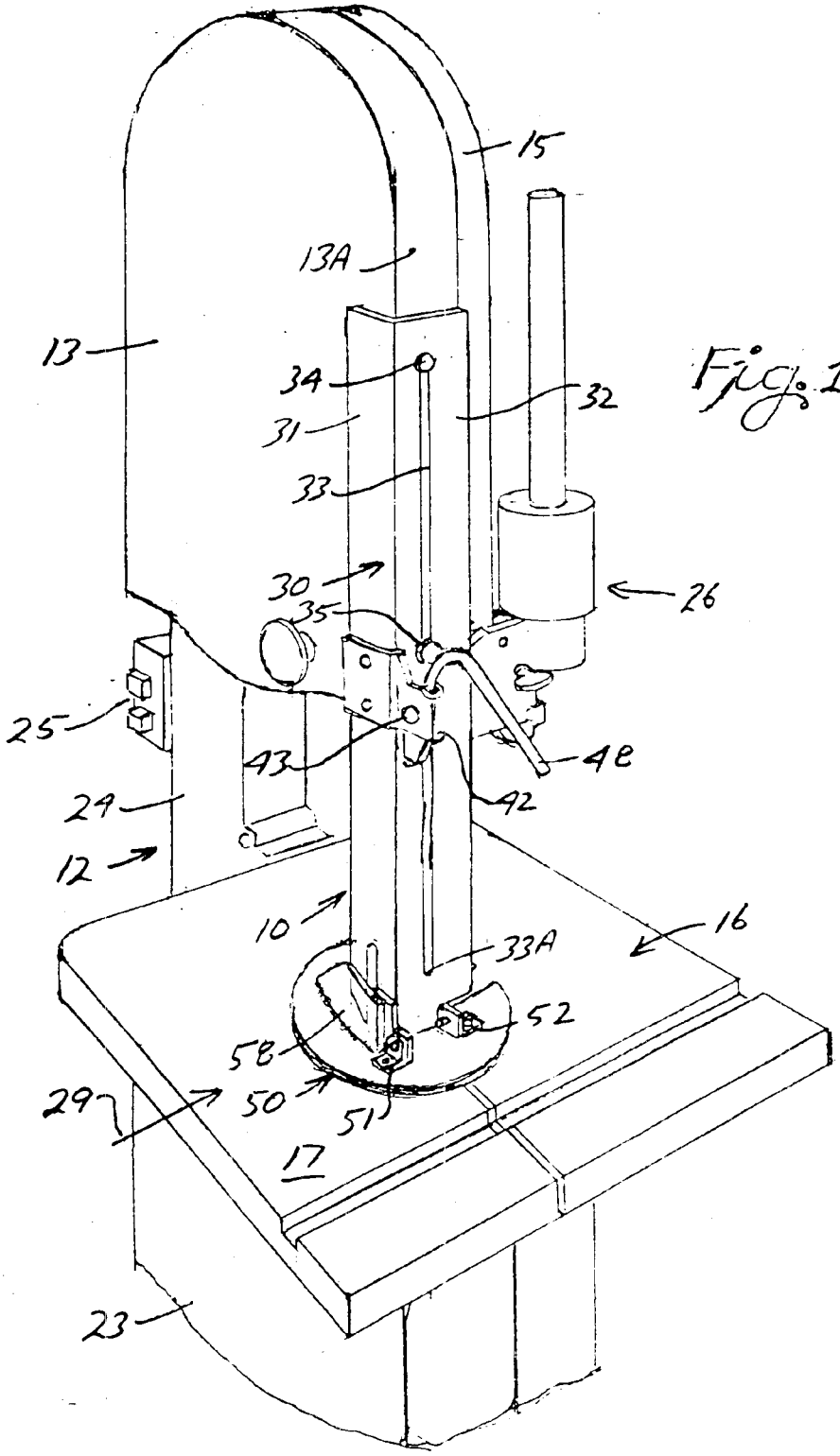
FIG. 1 is a front perspective view of a conventional power band saw having the safety device of the present invention mounted thereon and showing the safety device in a lower locked position.
Figure 2:
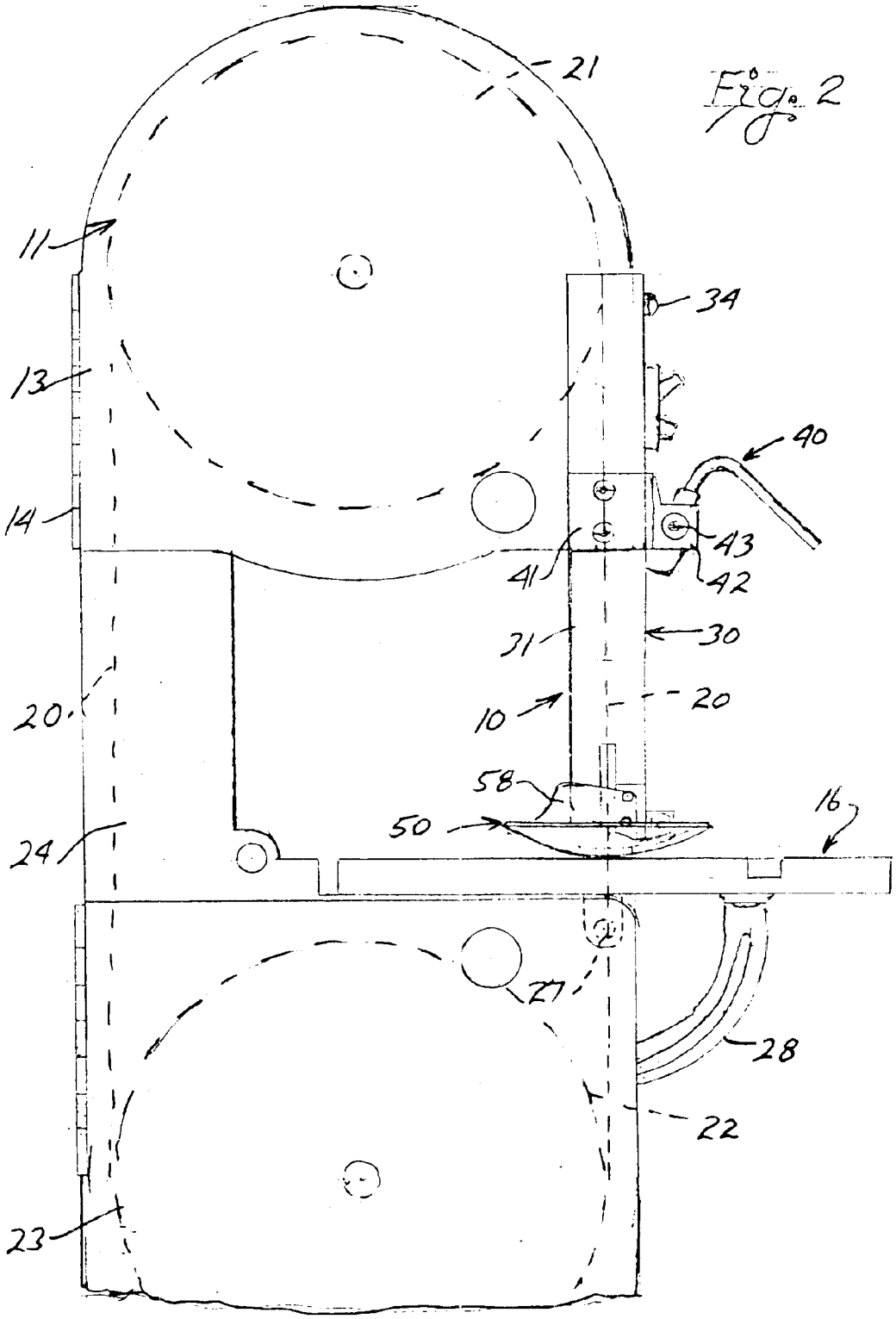
FIG. 2 is a partial side view taken from the right side of the band saw shown in FIG. 1.
Figure 7:
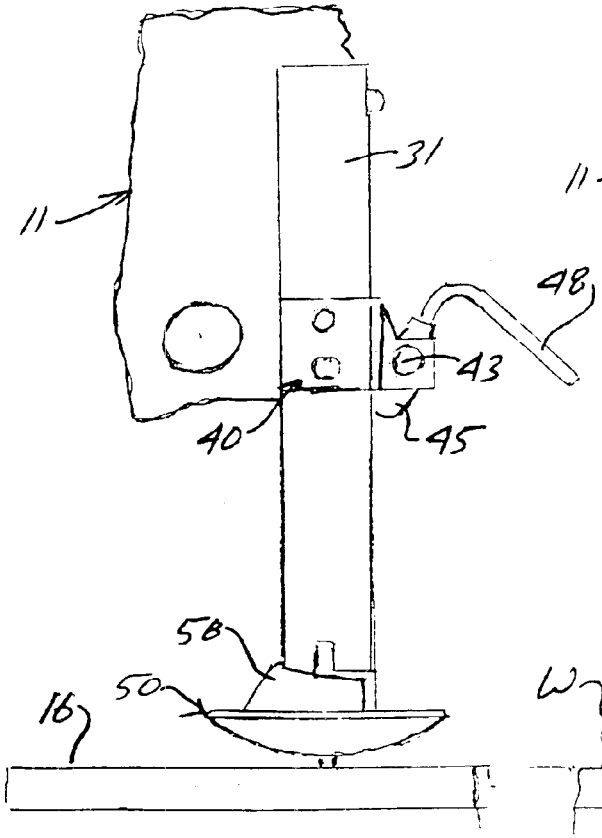
FIG. 7 is a side illustrational view showing the safety device of the invention in the lower locked position.

To secure the guard member 30 to the upper housing 11, a pair of guide pins 34 and 35 are welded or otherwise secured through the slot 33 in the flange 32 to a forward wall 13A of the pivotable closure 13 of the upper housing. The pins 34 and 35 are in spaced relationship to one another so as to prevent any pivotal movement of the guard member 30 relative to the housing while permitting a sliding motion of the guard vertically relative to the front wall 13A thereof. In use, the guard member 30 is movable from a first lower and safety position, as shown in FIGS. 1, 2 and 7, to a height which is only limited by the bottom 33A of the slot 33 formed in the front wall or flange 32 of the guard member. In this manner, substantially any size of workpiece may be positioned along the support surface 17 of the work table 16 as permitted by the adjustment in the height of the upper blade guide relative to the table 16. In the first or lower position shown in FIG. 1, it will be seen that the cutting edge of the saw blade is covered and protected by the side wall 31 of the guard member 30 wherein the forward normally exposed portion of the cutting blade is covered by the front wall or flange 32 thereof.

To provide for maximum safety, the present invention includes a locking mechanism 40 which is specifically designed to ensure that the guard member 30 is retained in the first or lower position, as shown in FIGS. 1–4 and 7, whenever there is no workpiece being acted on by the cutting blade. Thus, it is not possible to accidently lift or disengage the guard member 30 and it remains locked in place until intentionally and manually released by an operator.

Figure 4:
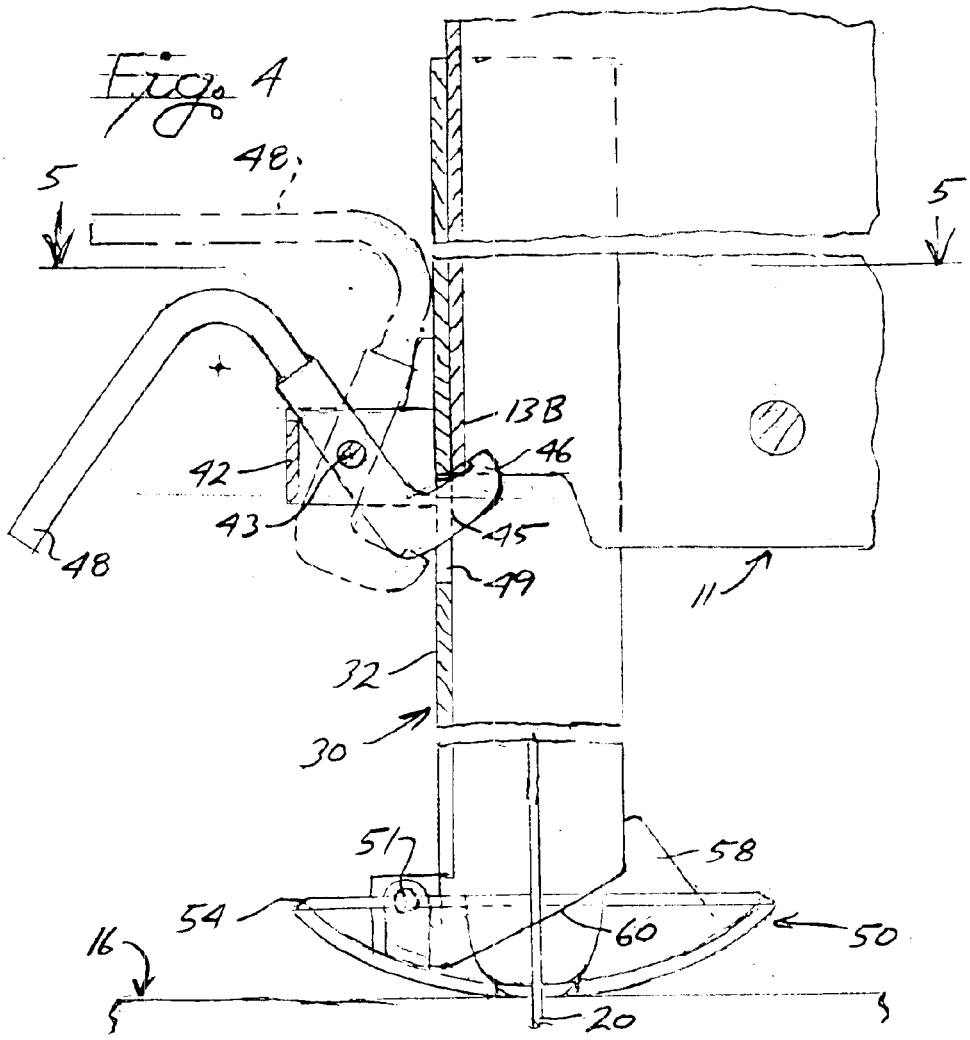
FIG. 4 is an enlarged cross sectional view having portions broken away taken along line 4—4 of FIG. 3.

In the embodiment shown, the locking mechanism 40 includes a bracket 41 which is securely mounted to the side wall or flange 31 of the guard member. The bracket includes an outer U-shaped component 42 having a pivot member 43 extending therethrough which extends through a portion of a catch member 45. The catch member has an inner hooked end 46 which engages an inner wall 13B of the front wall 13A of the door 13 of the housing 11 when in a locked position, as shown in FIG. 4. In this position, it is not possible to elevate the guard member 30 relative to the upper housing 11. Further, it is preferred that the locking mechanism or catch 45 be automatically pivoted to the locked position shown in FIG. 4 whenever the guard member is lowered to the safety position shown in FIGS. 1 and 4, thus whenever a workpiece is removed from a position beneath the guard member, the guard member automatically falls to its lower position and is automatically locked in position.

A preferred method of accomplishing an automatic locking feature is by providing a gravity actuated catch. In this respect, the locking catch member 45 includes an outer handle 48 which extends outwardly and forwardly of the guard member. The mass of the handle 48 is provided so as to ensure that there is a continuous force created about the pivot axis 43 to pivot the catch 45 to the locked position shown in FIG. 4. To release the catch 45, the handle must be elevated to the dotted line position of FIG. 4 thereby permitting movement of the guard member 30 relative to the upper housing 11. The catch hook 46 is pivotal through an opening 49 provided in the front wall 13A of the housing.

In view of the foregoing, the guard member covers and prevents accidental contact with the normally exposed portion of the band saw blade unless the locking mechanism is intentionally and manually released. Although other types of manual releases or locking mechanisms may be provided, it is preferred that the mechanism be such that it automatically engages whenever the guard member 30 is in its lowered position as shown in FIG. 4. Further, by providing a gravity actuated locking mechanism, the number of parts and operating characteristics are simplified, thus making it less likely that a component in the locking mechanism may fail and prevent the proper operating characteristics thereof. With the type of locking mechanism disclosed in the drawings, whenever the operator releases the handle 48 of the locking mechanism and the guard member 30 is lowered to its lower position, the catch 45 will automatically engage to prevent movement of the guard member until the handle is again raised by the operator to the release position shown in dotted line in FIG. 4.

Figure 6:
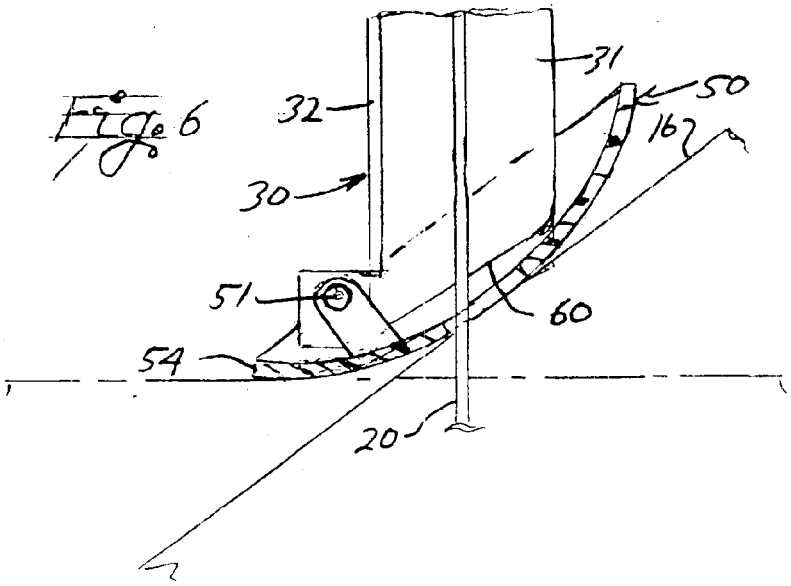
FIG. 6 is a cross sectional illustrational view showing the shield of the safety device of the present invention pivotally movable relative to the lower end of the guard of the invention wherein the shield is pivoted concurrently with a pivotal motion of a table of the band saw.

The present invention is also designed to prevent operator injury when the guard member 30 is released to allow it to be elevated to permit passage of a workpiece "W" relative to the band saw blade 20. In this respect, the invention includes a shield 50 which is pivotally mounted at 51 and 52 to the lower portion of the leading or front wall or flange 32 of the guard member 30. The shield 50 is pivotable so as to follow the inclination of the table 16 when the table is reoriented, such as shown in FIG. 6 wherein the table is shown as being tilted with its forward edge downwardly relative to the rear edge thereof.

The shield is preferably formed of a transparent material, such as a heavy duty plastic, which allows an operator to see therethrough during movement of a workpiece relative to the cutting blade 20. Further, it is preferred that the lower surface 53 of the shield 50 be formed in a convex configuration such that the outer generally continuous peripheral edge 54 thereof is elevated upwardly and oriented away from the upper support surface 17 of the table 16, as is clearly illustrated in the drawing figures. This provides a generally continuous beveled edge around the periphery of the shield which facilitates the introduction of a workpiece under the shield and which also facilitates the raising of the guard member 30 when the lock mechanism is released as previously described such that movement of the workpiece functions to provide a force to elevate the guard member, as is illustrated in FIG. 8, without the operator having to take any steps to lift or otherwise maneuver the guard member during passage of the workpiece relative to the band saw blade 20.

Figure 5:
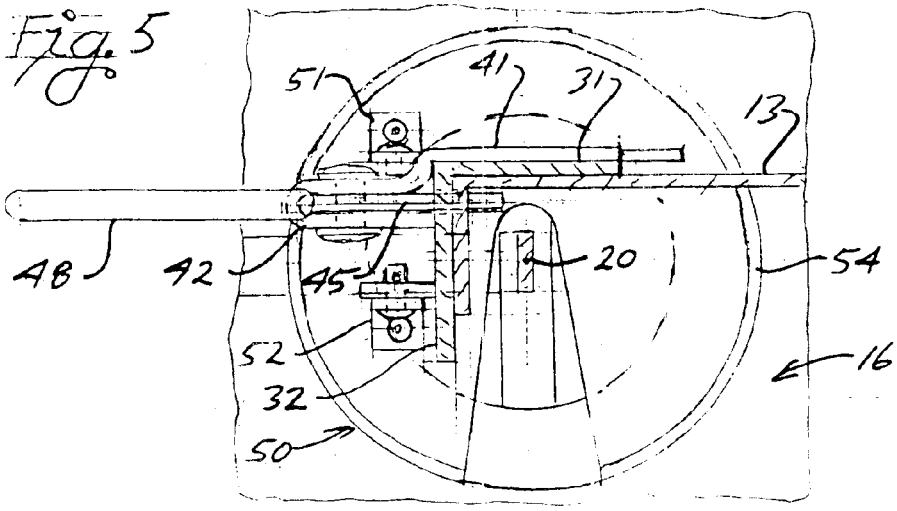
FIG. 5 is an enlarged cross sectional view taken along line 5—5 of FIG. 4.

As illustrated in the drawings, the outer peripheral edge of the shield extends outwardly at a distance beyond the guard member 30 so as to generally completely encircle the saw blade 20 which extends generally centrally therethrough through a slot 56 which extends from a central portion of the shield through a peripheral edge, as shown in FIG. 5.

Because of the shield and its outer peripheral edge extending away from the cutting blade 20, when an operator manipulates a workpiece "W" relative to the cutting blade, the shield provides a barrier for preventing the operator's hands from accidentally slipping into or toward the cutting blade as the workpiece is moved relative to the cutting blade, thus, providing a secondary safety feature. In essence, the shield 50 acts as a spacing element or barrier to block the movement of an operator's hands relative to the cutting blade and spaces the operator's hands outwardly therefrom as the workpiece is manipulated with respect to the band saw blade 20.

In order to provide reinforcement and for further guidance of the pivoting movement of the shield 50 relative to the lower edge of the guard member 30, a flange 58 may be provided extending upwardly from an upper concave surface 59 of the shield. To permit the pivoting movement of the shield relative to the lower edge of the guard member 30, the lower edge 60 of the side wall or flange 31 of the guard member is beveled upwardly away from the forward flange or wall 32, as is clearly shown in FIG. 4 of the drawings. In this way, the lower portion of the side wall will not prevent the pivotal movement of the shield.

The components of the present invention may be formed of metal or sturdy plastic materials, with it being preferred that the guard member and locking mechanism being formed of a metallic material and with the shield being formed of a transparent heavy duty plastic material. The actual diameter or configuration of the shield 50 may change but remain within the teachings of the present invention so long as the outer edge thereof provides a spacer to prevent movement of an operator's hands toward the cutting blade during manipulation of a workpiece relative to the band saw blade.

In the use of safety device of the present invention, when a workpiece is not being cut by the band saw, the guard member 30 will be in the lower and locked position shown in FIGS. 1–4 and 7 such that the lock catch 45 is engaged to prevent the guard member from being elevated accidentally by an operator. Once an operator places a workpiece "W" adjacent to the shield 50, the operator may then release the locking mechanism by elevating the handle 48 thereof to disengage the catch through the opening 49 in the front wall of the housing door 13. Thereafter, the workpiece may be urged toward the cutting blade in a direction generally indicated by the arrow 29 in FIG. 1. As the workpiece moves, the beveled edges of the shield will cause a force to be applied to elevate the guard member 30 vertically relative to the upper housing 30 of the band saw, with the elevation being limited to the height of the workpiece. Once the workpiece has passed in cutting relationship with respect to the band saw blade and from beneath the shield 50, the weight of the guard member 30 will cause it to automatically fall to its safe lower position, at which time the locking mechanism 40 will automatically lock the guard member in position. Therefore, the movement of the guard member to its locked position only requires that the workpiece be disengaged from the shield member 50. Locking is assured whenever a workpiece is not present as both the guard member 30 and the locking mechanism 40 operate automatically and, in the embodiment shown, automatically by gravity.

As a workpiece is moved beneath the shield member 50, the outer peripheral edge of the shield will act as a barrier to prevent movement of an operator's hands relative to the band saw blade 20, thus, providing further safety during use of the band saw.

This specific structure of the safety device of the present invention allows it to be retrofitted to existing conventional band saws or to be applied to newly constructed saws.

Although one specific locking mechanism 40 is disclosed, it is conceived that other automatic locking devices may be utilized and be within the teachings of the present invention so long as such locking mechanisms lock automatically upon the lowering of the guard member to its lower safety position.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalent.

We claim:

1. A safety device for a band saw having a table defining a work support surface, a continuous band saw blade, and an upper housing through which an upper portion of the blade extends with such housing being in vertically spaced relationship from the table, the safety device comprising: a guard member having upper and lower ends, said guard member being slidably adjustably mounted to the upper housing so as to be movable from a lower position in which said lower end is adjacent to the work support surface of the table to a raised position spaced above the work support surface of the table to thereby permit a workpiece to pass beneath said lower end to be cut by a cutting edge of the band saw blade, a locking mechanism movable from a first locked position for normally retaining said guard member in said lower position to a second unlocked position to release said guard member to be movable to said raised position thereof, said locking mechanism being automatically actuated to move to said locked position upon movement of said guard member to said first lower position thereof whereby said guard member is automatically locked in said lower position to prevent accidental contact with the band saw blade, a shield pivotally mounted to said lower end of said guard member, said shield having a generally continuous outer peripheral edge extending outwardly relatively transversely with respect to said lower end of said guard member, and said shield having an opening therein through which the band saw blade passes such that said peripheral edge provides a radial guard to prevent accidental contact with the band saw blade.

2. The safety device of claim 1 wherein said peripheral edge of said shield is arcuately curved upwardly away from the table to thereby facilitate movement of said guard member when said locking mechanism is in said second unlocked position thereof by a workpiece passing beneath said shield relative to the band saw blade.

3. The safety device of claim 2 wherein said shield includes a generally convex lower surface.

4. The safety device of claim 3 wherein a portion of said lower end of said guard member is beveled to permit pivoting of said shield relative thereto.

5. The safety device of claim 1 in which said shield is transparent.

6. The safety device of claim 1 in which said locking mechanism includes a bracket mounted to said guard member, an opening in the upper housing, a catch member pivotally mounted to said bracket so as to be movable from a first position in engagement through said opening with an inner edge of the upper housing to a second position wherein said catch member is pivoted away from the upper housing to permit movement of said guard member relative to the upper housing.

7. The safety device of claim 6 in which said catch member is gravity operated such that whenever said guard member is in said lower position, said catch member is engaged with the upper housing to prevent movement of said guard member.

8. The safety device of claim 7 in which said catch member includes an outwardly extended handle for manual manipulation which is weighted so as to continuously pivot said catch member toward the upper housing.

9. The safety device of claim 8 in which said guard member is generally L-shaped in cross section having a side flange adapted to be secured to a side of the upper housing and a front flange adapted to be mounted to a front of the upper housing, an elongated slot in said front flange, and guide means extending through said elongated slot for slidably mounting said guide member to the upper housing.

10. A safety device for a band saw having a table defining a work support surface, a continuous band saw blade, and an upper housing through which an upper portion of the blade extends with such housing being in vertically spaced relationship from the table, the safety device comprising: a guard member having up er and lower ends, said guard member being slidably adjustably mounted to the upper housing so as to be movable from a lower position in which said lower end is adjacent to the work support surface of the table to a raised position spaced above the work support surface of the table to thereby permit a workpiece to pass beneath said lower end to be cut by a cutting edge of the band saw blade, a locking mechanism movable from a first locked position for normally retaining said guard member in said lower position to a second unlocked position to release said guard member to be movable to said raised position thereof, said locking mechanism being automatically actuated to move to said first locked position upon movement of said guard member to said lower position thereof whereby said guard member is automatically locked in said lower position to prevent accidental contact with the band saw blade, said locking mechanism including a bracket mounted to said guard member, an opening in the upper housing, and a catch member pivotally mounted to said bracket so as to be movable from a first position in engagement through said opening with an inner edge of the upper housing to a second position wherein said catch member is pivoted away from the upper housing to permit movement of said guard member relative to the upper housing.

11. The safety device of claim 10 in which said catch member is gravity operated such that whenever said guard member is said lower position, said catch member is engaged with the upper housing to prevent movement of said guard member.

12. The safety device of claim 11 in which said catch member includes an outwardly extended handle for manual manipulation which is weighted so as to continuously pivot said catch member toward the upper housing.

13. The safety device of claim 12 in which said guard member is generally L-shaped in cross section having a side flange adapted to be secured to a side of the upper housing and a front flange adapted to be mounted to a front of the upper housing, an elongated slot in said front flange, and guide means extending through said elongated slot for slidably mounting said guide member to the upper housing.

14. A band saw comprising: a table defining a work support surface, a continuous band saw blade, and an upper housing through which an upper portion of the blade extends with such housing being in vertically spaced relationship from the table, a safety device including a guard member having upper and lower ends, said guard member being slidably adjustably mounted to said upper housing so as to be movable from a lower covering position in which said lower end is adjacent to said work support surface of said table to a raised position spaced above said work support surface of said table to thereby permit a workpiece to pass beneath said lower end to be cut by a cutting edge of said band saw blade, a locking mechanism movable from a first locked position for normally retaining said guard member in said lower position to a second unlocked position to release said guard member to be movable to said raised position thereof, said locking mechanism being automatically actuated to move to said first locked position upon movement of said guard member to said lower position thereof whereby said guard member is automatically locked in said lower position to prevent accidental contact with said band saw blade, a shield pivotally mounted to said lower end of said guard member, said shield having a generally continuous outer peripheral edge extending outwardly relatively transversely with respect to said lower end of said guard member, and said shield having an opening therein through which the band saw blade passes such that said peripheral edge provides a radial guard to prevent accidental contact with the band saw blade.

15. The band saw of claim 14 wherein said opening in said shield is formed as an open slot extending from a central portion thereof through said peripheral edge thereof through which said band saw blade passes.

16. The safety device of claim 14 wherein said peripheral edge of said shield is arcuately curved upwardly away from said table to thereby facilitate movement of said guard member when said locking mechanism is in said second unlocked position thereof by a workpiece passing beneath said shield relative to said band saw blade.

17. The safety device of claim 14 in which said locking mechanism includes a bracket mounted to said guard member, an opening in said upper housing, a catch member pivotally mounted to said bracket so as to be movable from a first position in engagement through said opening with an inner edge of said upper housing to a second position wherein said catch member is pivoted away from said upper housing to permit movement of said guard member relative to said upper housing.

18. The safety device of claim 17 in which said catch member is gravity operated such that whenever said guard member is said lower position, said catch member is engaged with said upper housing to prevent movement of said guard member.

19. The safety device of claim 18 in which said guard member is generally L-shaped in cross section having a side flange secured to a side of said upper housing and a front flange mounted to a front of said upper housing, an elongated slot in said front flange, and guide means extending through said elongated slot for slidably mounting said guide member to said upper housing.

* * * * *

UNITED STATES PATENT AND TRADEMARK OFFICE

CERTIFICATE OF CORRECTION

PATENT NO. : 6,857,347 B1
APPLICATION NO. : 10/389809
DATED : February 22, 2005
INVENTOR(S) : Benedict et al.

It is certified that error appears in the above-identified patent and that said Letters Patent is hereby corrected as shown below:

Inventor's name listed as "Christian Tallahassee Yates" should be corrected to read:
--Christian A. Yates--

Signed and Sealed this

Thirtieth Day of October, 2007

JON W. DUDAS
*Director of the United States Patent and Trademark Office*